US009821428B2

(12) United States Patent
Yoshikawa et al.

(10) Patent No.: US 9,821,428 B2
(45) Date of Patent: Nov. 21, 2017

(54) POLISHING APPARATUS AND METHOD THEREFOR

(71) Applicant: MITSUBISHI HEAVY INDUSTRIES, LTD., Tokyo (JP)

(72) Inventors: Yoshinobu Yoshikawa, Tokyo (JP); Yoichi Ishigami, Tokyo (JP); Yoshihiko Higashiguchi, Tokyo (JP); Yoshitake Kasubata, Tokyo (JP); Yuichi Sasaki, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 254 days.

(21) Appl. No.: 14/387,983

(22) PCT Filed: Mar. 5, 2013

(86) PCT No.: PCT/JP2013/055997
§ 371 (c)(1),
(2) Date: Sep. 25, 2014

(87) PCT Pub. No.: WO2013/146121
PCT Pub. Date: Oct. 3, 2013

(65) Prior Publication Data

US 2015/0321308 A1 Nov. 12, 2015

(30) Foreign Application Priority Data

Mar. 29, 2012 (JP) ..... 2012-077766

(51) Int. Cl.
*B24B 5/08* (2006.01)
*B24B 41/04* (2006.01)
(Continued)

(52) U.S. Cl.
CPC ..... *B24B 5/08* (2013.01); *B24B 5/06* (2013.01); *B24B 9/00* (2013.01); *B24B 41/002* (2013.01); *B24B 41/04* (2013.01); *B24B 41/047* (2013.01)

(58) Field of Classification Search
CPC ..... B24B 41/002; B24B 41/04; B24B 41/047; B24B 5/06; B24B 5/08; B24B 9/00
(Continued)

(56) References Cited

U.S. PATENT DOCUMENTS 2,948,087 A * 8/1960 Caton ..... B24B 7/12 15/77
4,128,968 A * 12/1978 Jones ..... B24B 13/0018 451/158
(Continued)

FOREIGN PATENT DOCUMENTS

GB 2194450 A 3/1988
JP 55-70954 U 5/1980
(Continued)

OTHER PUBLICATIONS

English translation of the Written Opinion dated Apr. 23, 2013, of International Application No. PCT/JP2013/055997 (5 pages).
(Continued)

*Primary Examiner* — Marc Carlson
(74) *Attorney, Agent, or Firm* — Westerman, Hattori, Daniels & Adrian

(57) ABSTRACT

A polishing apparatus is provided with a machining head that is supported to freely move in two horizontal directions; driving devices that enables the machining head to move; a polishing jig that is supported by the machining head to freely move in a vertical direction; a polishing member that is mounted on a lower end portion of the polishing jig; an air cylinder polishing jig moving device that moves the polish-
(Continued)

ing jig and is capable of pressing the polishing member against a tube support plate; and a drive motor that is capable of rotating the polishing jig, thus, simplification of the structure is made possible.

10 Claims, 14 Drawing Sheets

(51) Int. Cl.
*B24B 41/047* (2006.01)
*B24B 5/06* (2006.01)
*B24B 41/00* (2006.01)
*B24B 9/00* (2006.01)

(58) Field of Classification Search
USPC ..... 451/57
See application file for complete search history.

(56) References Cited

U.S. PATENT DOCUMENTS 5,105,583 A * 4/1992 Hammond ..... B24B 9/00 451/271
5,934,979 A * 8/1999 Talieh ..... B24B 21/004 451/271
6,193,588 B1 * 2/2001 Carlson ..... B24B 21/04 451/168
6,331,139 B2 * 12/2001 Walker ..... B24B 21/04 451/288
6,387,807 B1 * 5/2002 Faubert ..... H01L 21/3212 257/E21.304
6,602,110 B2 * 8/2003 Yi ..... B24B 37/005 451/5
6,626,744 B1 * 9/2003 White ..... B24B 21/04 451/168
7,632,171 B2 * 12/2009 Heesemann ..... B24B 7/06 451/190
9,162,339 B2 * 10/2015 Zhang ..... B24B 37/005 451/5
2005/0070210 A1 * 3/2005 Jeong ..... B24B 37/013 451/8
2007/0099546 A1 * 5/2007 Jespersen ..... B24B 7/06 451/11
2009/0124180 A1 * 5/2009 Chacich ..... B24B 7/075 451/260
2011/0003539 A1 * 1/2011 Jespersen ..... B24B 7/26 451/261
2011/0086753 A1 * 4/2011 Moon ..... B24B 7/242 501/11

FOREIGN PATENT DOCUMENTS

JP 60-56862 A 4/1985
JP 1-135463 A 5/1989
JP 5-84652 A 4/1993
JP 7-276203 A 10/1995
JP 8-318457 A 12/1996
JP 2891035 B2 5/1999
JP 3852803 B2 12/2006
JP 2010-58241 A 3/2010
JP 2011-136382 A 7/2011
WO 99/22905 A1 5/1999

OTHER PUBLICATIONS

Extended European Search Report dated Nov. 11, 2015, issued in counterpart Application No. 13768869.3 (8 pages).
International Search Report dated Apr. 23, 2013, issued in corresponding application No. PCT/JP2013/055997.
Written Opinion of the International Search Report dated Apr. 23, 2013, issued in corresponding application No. PCT/JP2013/055997.
Decision of a Patent Grant dated Jul. 21, 2015, issued in counterpart Japanese Patent Application No. 2012-077766, with English translation. (4 pages).

* cited by examiner

POLISHING APPARATUS AND METHOD THEREFOR

FIELD

The present invention relates to a polishing apparatus that polishes periphery of a hole formed in a workpiece such as a tube support plate to support a heat exchanger tube, for example, in a steam generator used as a heat exchanger in a nuclear power plant.

BACKGROUND

For example, in a pressurized water reactor (PWR), light water is used as reactor coolant and neutron moderator to be high-temperature and high-pressure water that does not boil over the entire reactor internal, the high-temperature and high-pressure water is sent to the steam generator to generate steam by heat exchange, and the steam is sent to a turbine generator to generate electricity. Moreover, the steam generator is configured so that a plurality of heat exchanger tubes having an inverted U-shape is provided inside, end portions of each heat exchanger tube are supported by a tube sheet, and an inlet side channel head and an outlet side channel head of primary cooling water are formed in a lower end portion of a body portion. Further, an inlet portion of secondary cooling water is provided in the body portion to be located above a tube bundle shroud, a gas-water separator and a moisture separator are vertically arranged side by side, and a steam outlet is provided above the gas-water separator and the moisture separator.

In such a steam generator, multiple heat exchanger tubes provided inside the body portion are supported by a plurality of tube support plates and tube sheets. When the heat exchanger tubes are inserted into holes formed in large numbers, the tube support plate supports the multiple heat exchanger tubes to prevent vibration. In this case, the holes of the tube support plate form a special shape such that a steam circulating gap is formed between the tube support plate and the heat exchanger tube to be supported, rather than a circular shape. In this case, by broaching the tube support plate after the circular prepared holes are formed, holes of a special shape (broached holes) are formed, and on the end portions of the broached holes are chamfered. In addition, as a machining device of the holes, for example, there is a device described in Patent Literature 1.

CITATION LIST

Patent Literature

Patent Literature 1: Japanese Laid-open Patent Publication No. 08-318457

SUMMARY

Technical Problem

The above-described polishing apparatus described in Patent Literature 1 performs polishing by inserting a polishing body into the tube holes of the tube support plate while performing a reciprocating motion of the polishing body. However, since the polishing apparatus of the related art performs polishing on the inner peripheral surfaces in the tube holes of the tube support plate by the polishing body, there are problems in that it is not possible to properly perform chamfering on the end portions of the tube holes, and from the need for reciprocating motion of the polishing body, the shape of the polishing body and the structure of the apparatus become complicated.

The present invention has been made to solve the above-described problems, and an object thereof is to provide a polishing apparatus that enables simplification of the structure, and a method thereof.

Solution to Problem

According to an aspect of the present invention, a polishing apparatus includes: a machining head that is supported to freely move in two intersecting directions; a machining head moving device that allows the machining head to move; a polishing jig that is supported by the machining head to freely move in a direction intersecting a direction of movement of the machining head; a polishing member that is mounted on a leading end portion of the polishing jig; a polishing jig moving device that moves the polishing jig and is capable of pressing the polishing member against a workpiece; and a polishing jig rotating device that is capable of rotating the polishing jig about an axis center along the direction of movement of the polishing jig.

Thus, the polishing jig supported on the machining head rotates by a polishing jig rotating device, is pressed against the workpiece by a polishing jig moving device, and is moved by the machining head moving device. Thus, it is possible to properly polish a machining surface of the workpiece by a polishing member mounted on the polishing jig, and it is possible to simplify the structure by the simple configuration.

Advantageously, in the polishing apparatus, at least two polishing jigs are provided and are capable of rotating by the polishing jig rotating device in different directions.

Thus, by using the different rotational directions of the two polishing jigs, the polishing member is brought into contact with the machining surface of the workpiece from the different directions, and thus the stable polishing can be performed.

Advantageously, in the polishing apparatus, sandpaper or polishing brush as the polishing member can be mounted to a leading end portion of the polishing jig.

Therefore, by applying the sandpaper and the polishing brush as the polishing member, since the members having the different hardness and shape comes into contact with the machining surface of the workpiece, it is possible to properly polish the machining surface.

According to another aspect of the present invention, a polishing method of polishing an edge portion of a hole formed in a workpiece, includes: a first step of mounting sandpaper to a leading end portion of a polishing jig, pressing the sandpaper against the workpiece while rotating the polishing jig, and moving the sandpaper along a machining surface of the workpiece; and a second step of mounting the polishing brush to the leading end portion of the polishing jig, pressing the polishing brush against the workpiece while rotating the polishing jig, and moving the polishing brush along a machining surface of the workpiece.

Therefore, at a first step, by polishing the machining surface of the workpiece by the sandpaper, it is possible to remove burrs formed on the edge portion of the hole of the workpiece, and at a second step, by polishing the machining surface of the workpiece by the polishing brush, it is possible to polish the edge portion of the hole from which burrs are removed, thereby properly polishing the machining surface of the workpiece, and simplifying the structure by the simple configuration.

Advantageously, in the polishing method, the workpiece is polished while rotating at least two polishing jigs in different directions.

Therefore, since the polishing member is brought into contact with the machining surface of the workpiece from the different directions, it is possible to perform the stable polishing.

Advantageously, in the polishing method, after moving the polishing jig in a first direction along the machining surface of the workpiece to polish the workpiece, the polishing jig is moved in a second direction intersecting the first direction along the machining surface of the workpiece to polish the workpiece.

Therefore, since the polishing member is pressed against the machining surface of the workpiece from the different directions, it is possible to perform the stable polishing.

Advantageous Effects of Invention

According to the polishing apparatus of the present invention and the method thereof, since the polishing jig is moved in a state of being pressed against the workpiece while rotating to polish the workpiece, it is possible to properly polish the machining surface of the workpiece by the polishing member. Further, it is possible to simplify the structure by the simple configuration.

BRIEF DESCRIPTION OF DRAWINGS

FIG. 13-1 is a plan view illustrating a prepared hole of a tube support plate.

FIG. 13-2 is a plan view illustrating the prepared hole of the tube support plate and an R chamfered portion.

FIG. 13-3 is a plan view illustrating a broached hole of the tube support plate.

DESCRIPTION OF EMBODIMENTS

Preferred embodiments of the polishing apparatus of the present invention and the method thereof will be described below in detail with reference to the accompanying drawings. In addition, the present invention is not limited to the embodiments, and when there is a plurality of embodiments, a configuration obtained by combining each embodiment may be included.

Examples

Figure 1:
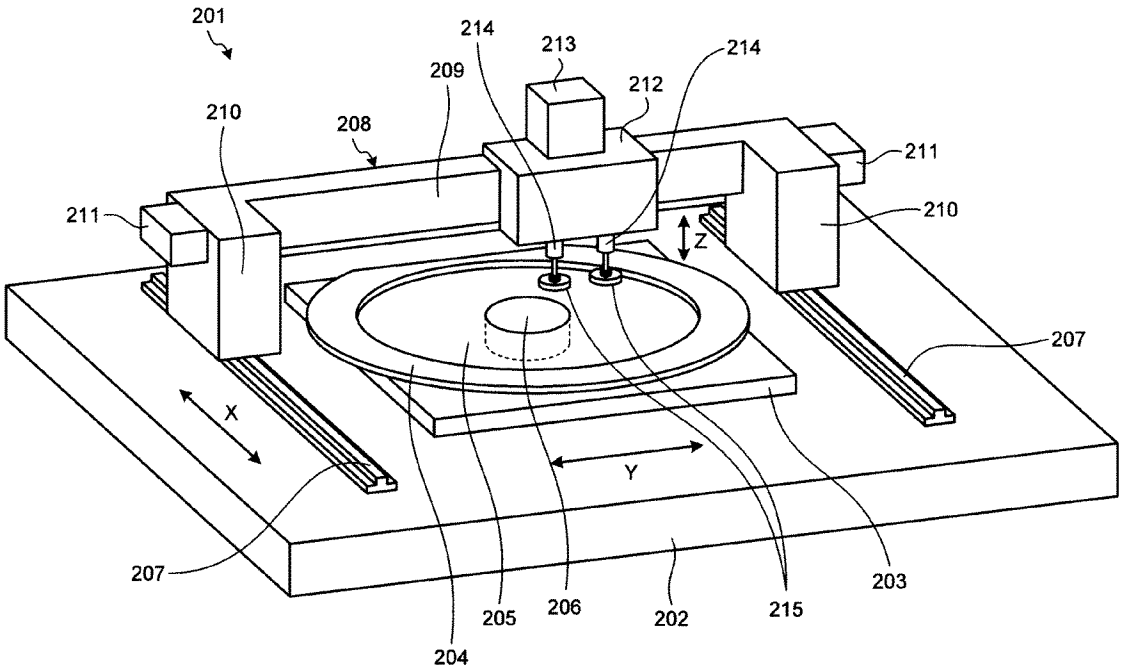
FIG. 1 is a schematic view of a polishing apparatus according to an embodiment of the present invention.
Figure 2:
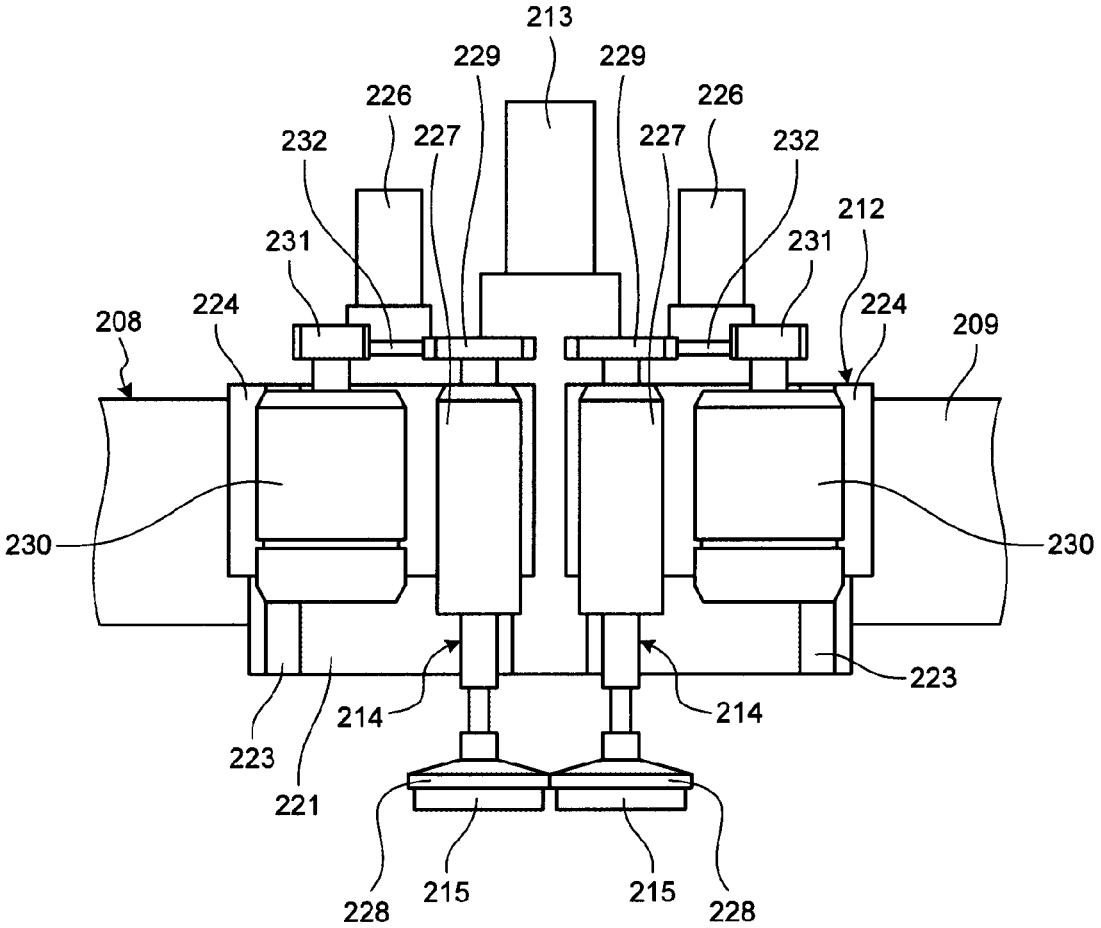
FIG. 2 is a front view of a machining head in the polishing apparatus of this embodiment.
Figure 3:
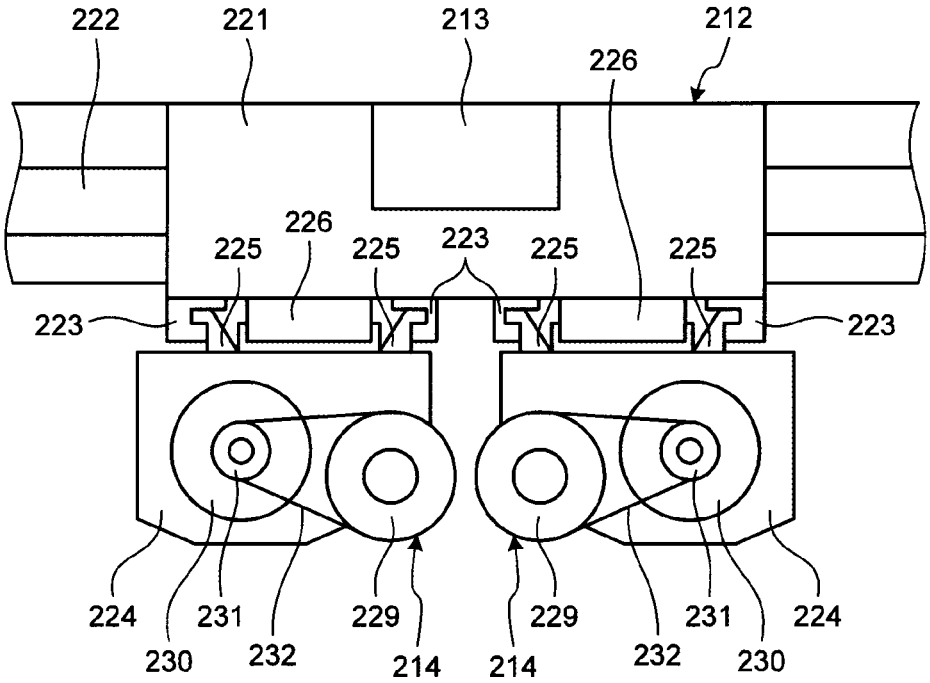
FIG. 3 is a plan view of the machining head in the polishing apparatus of this embodiment.
Figure 4:
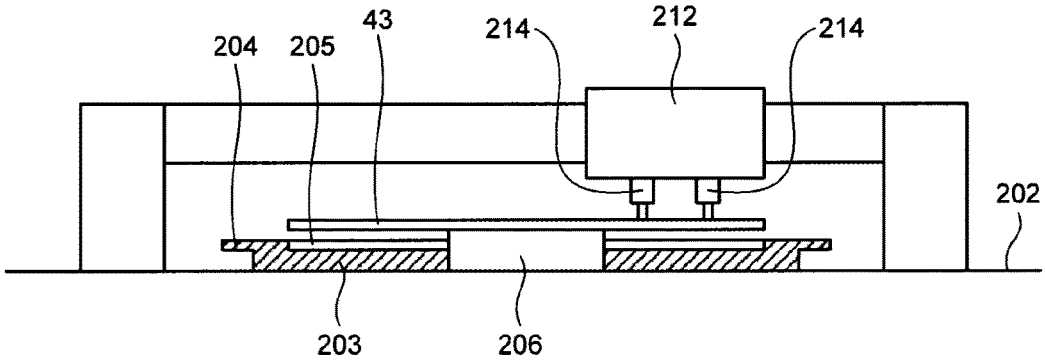
FIG. 4 is a front view illustrating a support base in the polishing apparatus of this embodiment.
Figure 5:
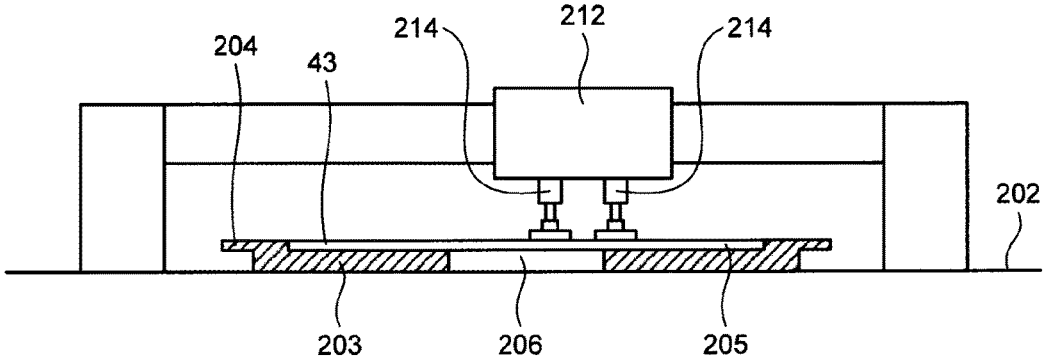
FIG. 5 is a front view illustrating the support base in the polishing apparatus of this embodiment.
Figure 6:
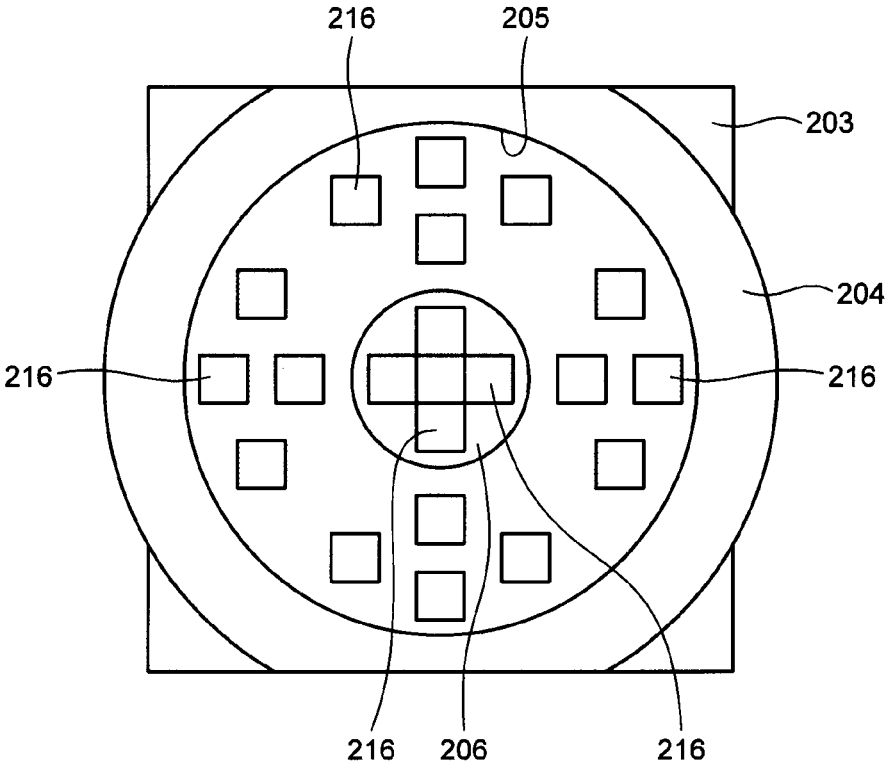
FIG. 6 is a plan view illustrating the support base in the polishing apparatus of this embodiment.
Figure 7:
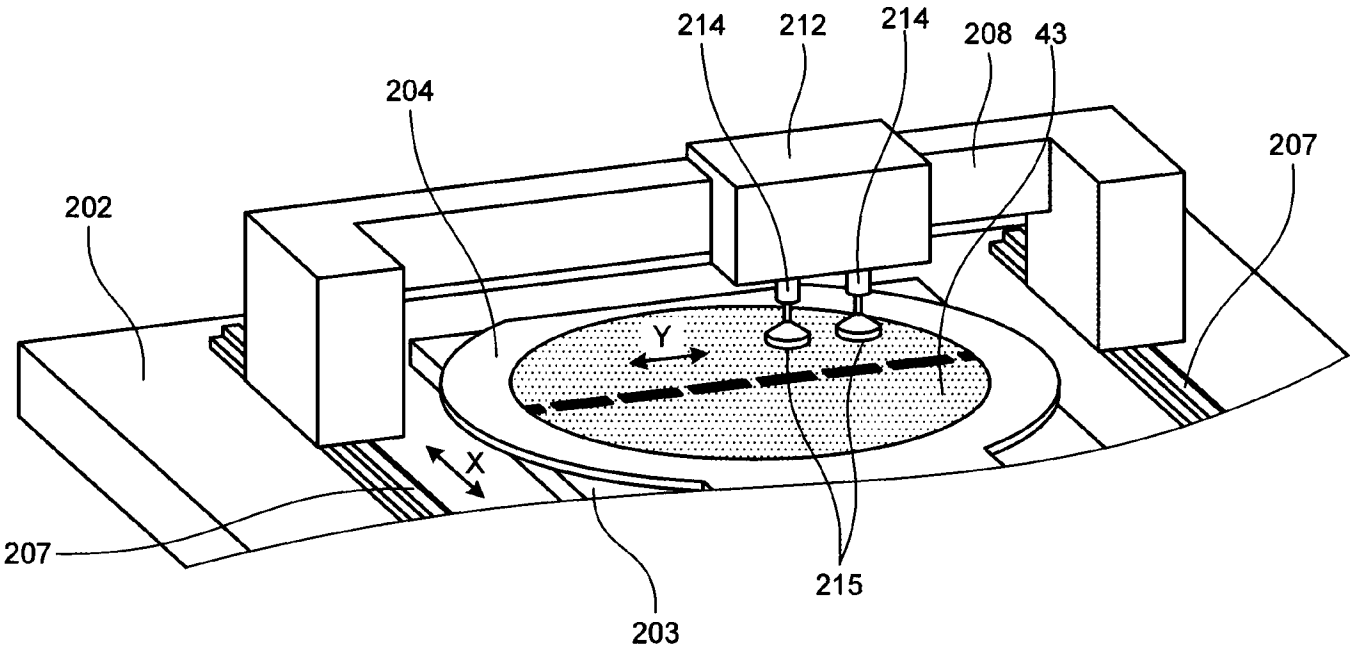
FIG. 7 is a schematic view illustrating a polishing method using the polishing apparatus of this embodiment.
Figure 8:
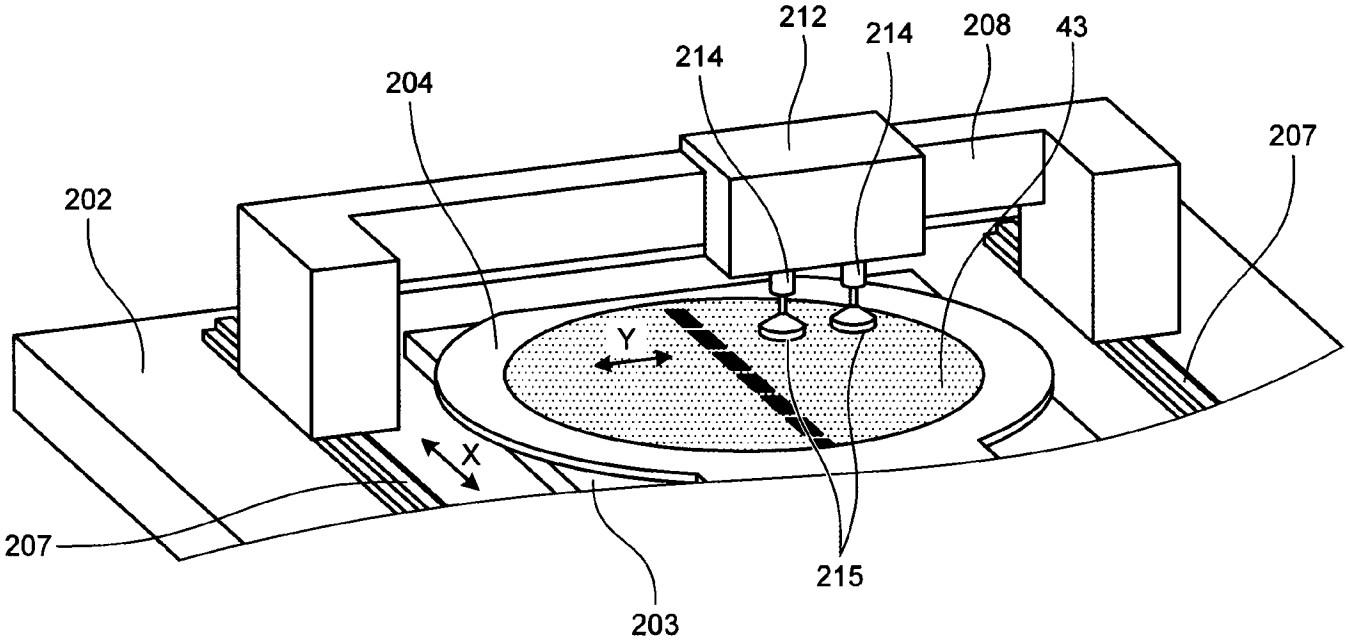
FIG. 8 is a schematic view illustrating the polishing method using the polishing apparatus of this embodiment.
Figure 9:
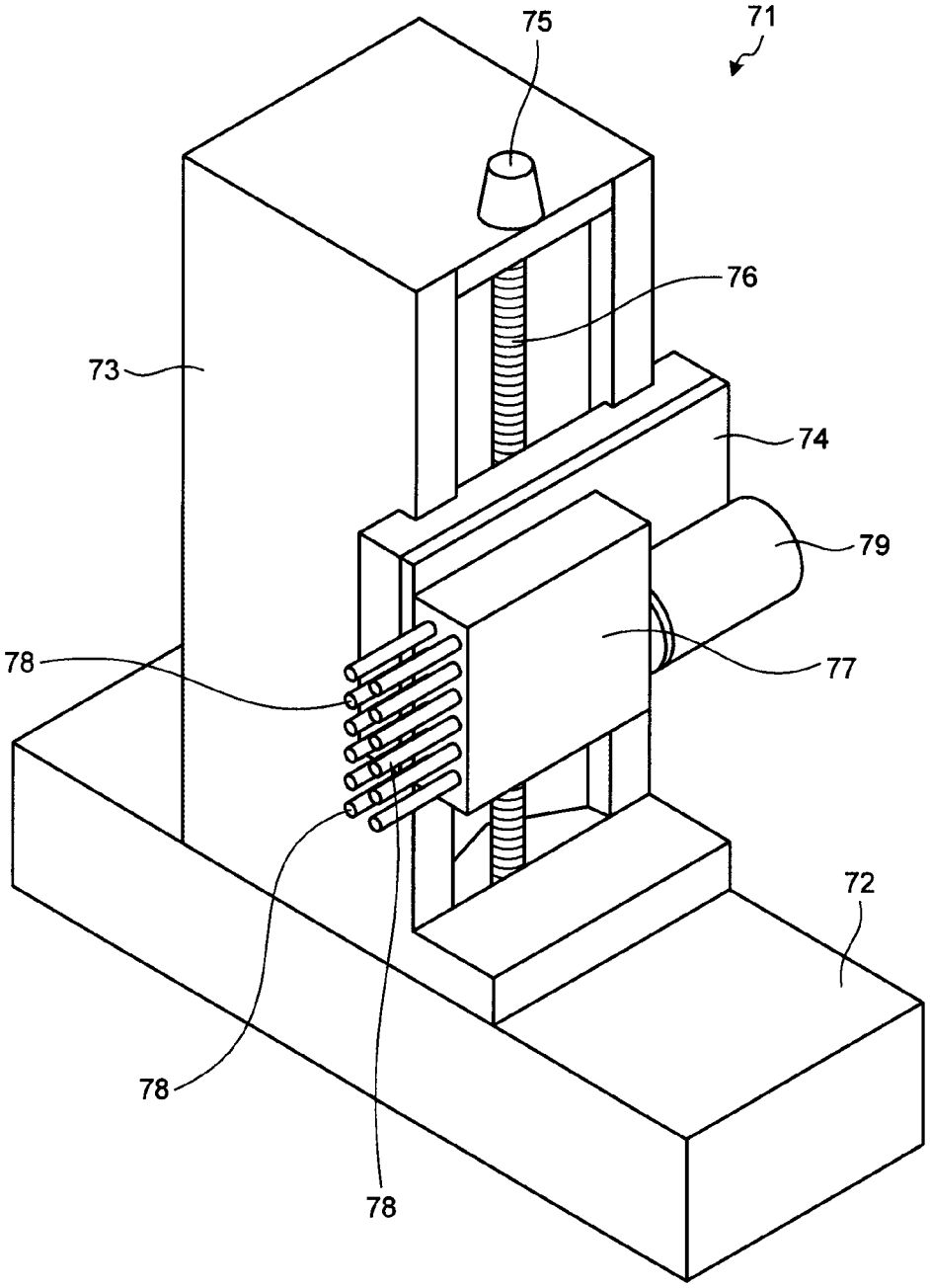
FIG. 9 is a schematic view illustrating an R chamfering device.
Figure 10:
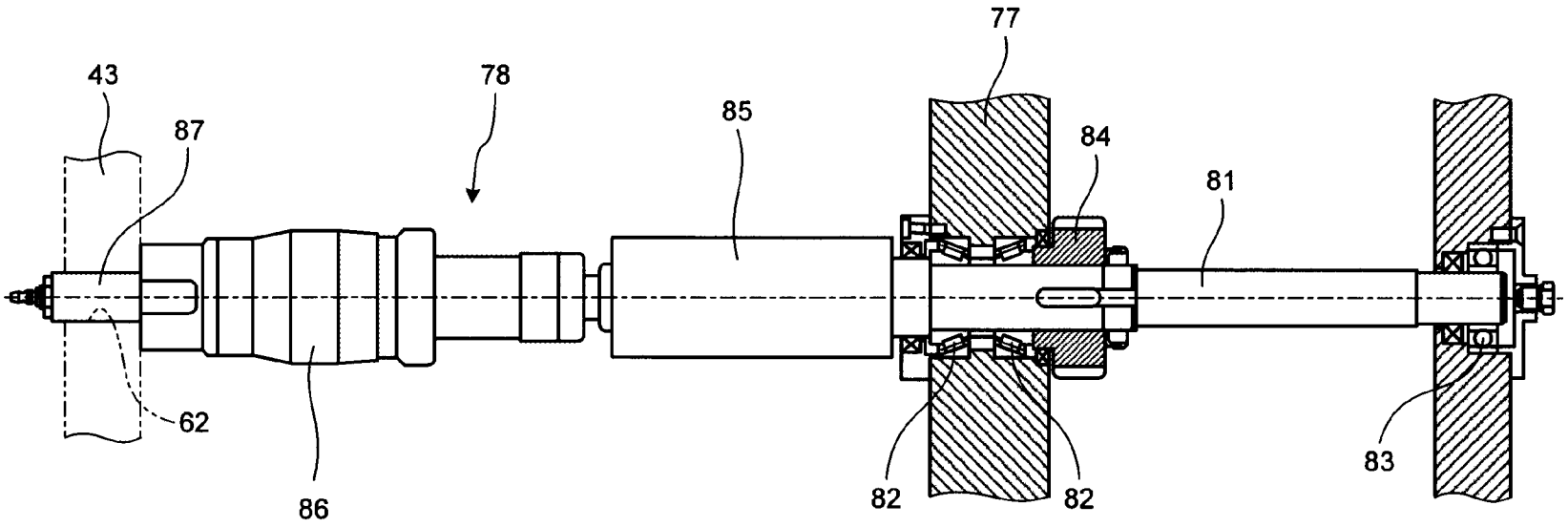
FIG. 10 is a front view illustrating a spindle in the R chamfering device.
Figure 11:
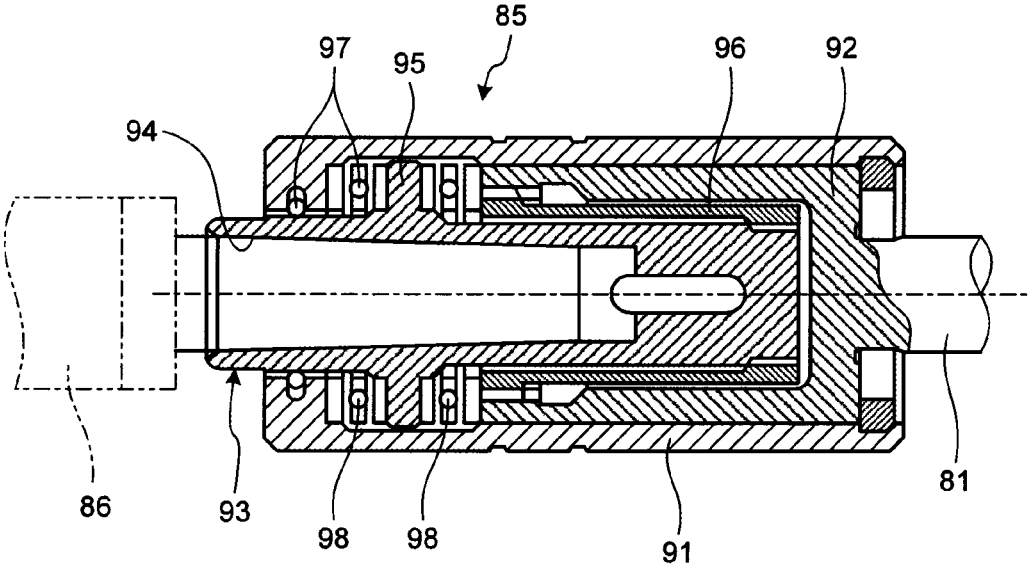
FIG. 11 is a cross-sectional view of a floating holder.
Figure 12:
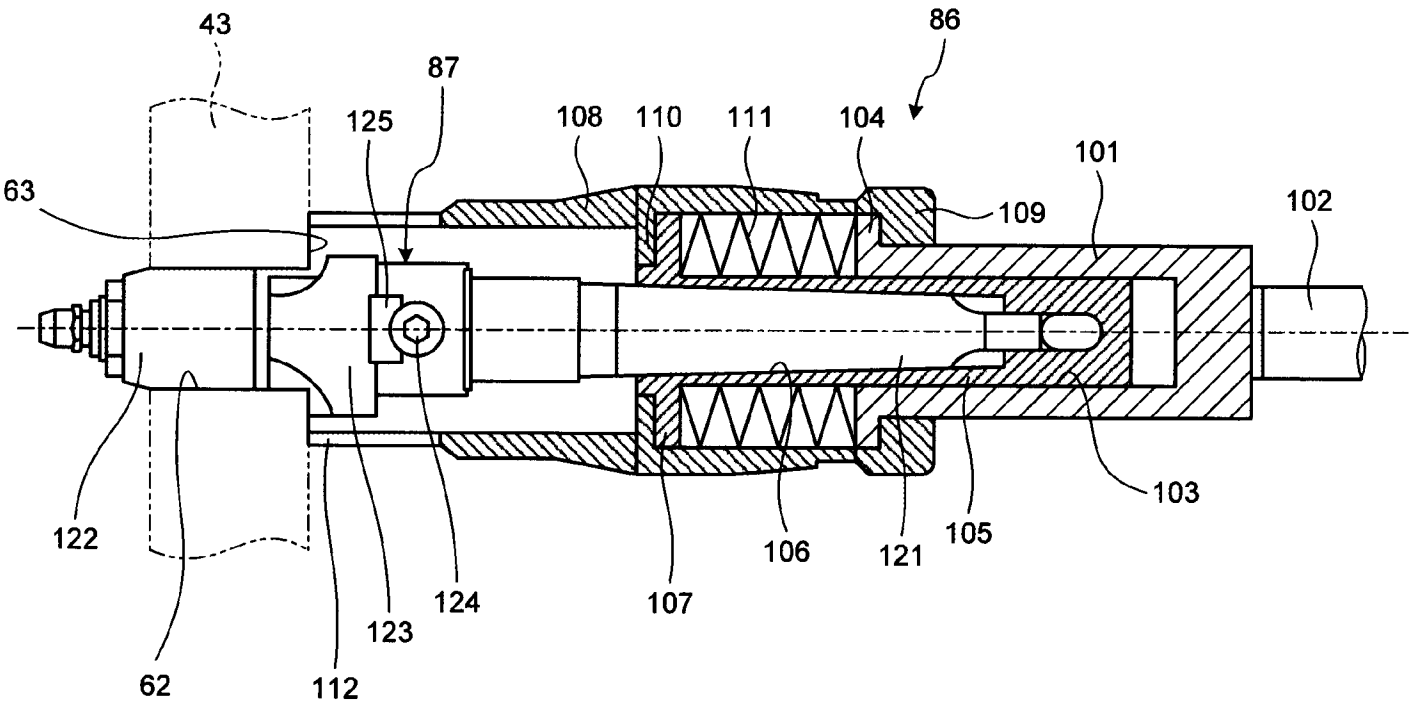
FIG. 12 is a cross-sectional view of a depth-adjusting holder.
Figures 1, 13:
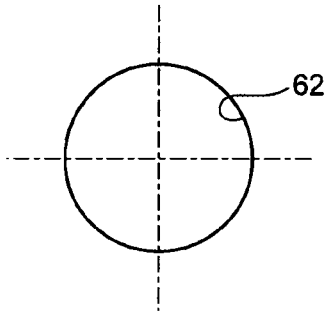
Figures 2, 13:
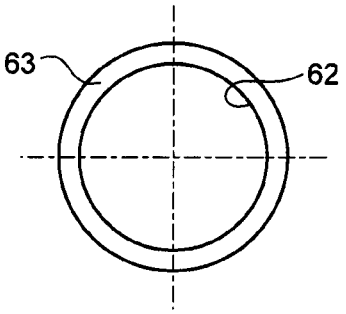
Figures 3, 13:
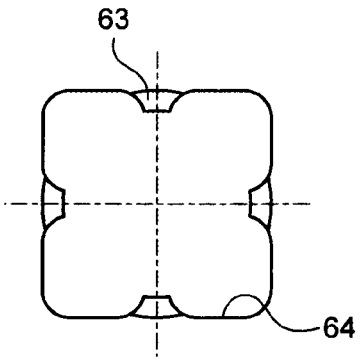
Figure 14:
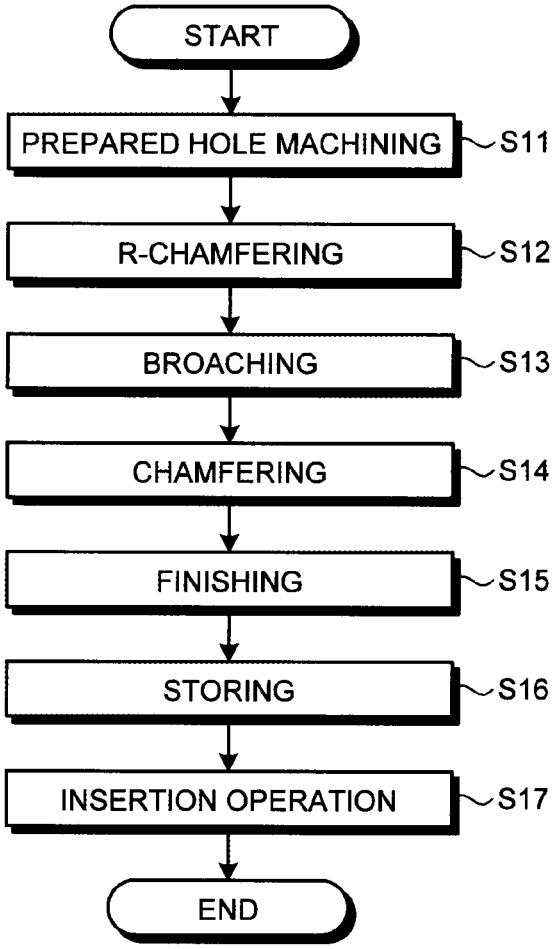
FIG. 14 is a flow chart illustrating a hole machining method of the tube support plate.
Figure 15:
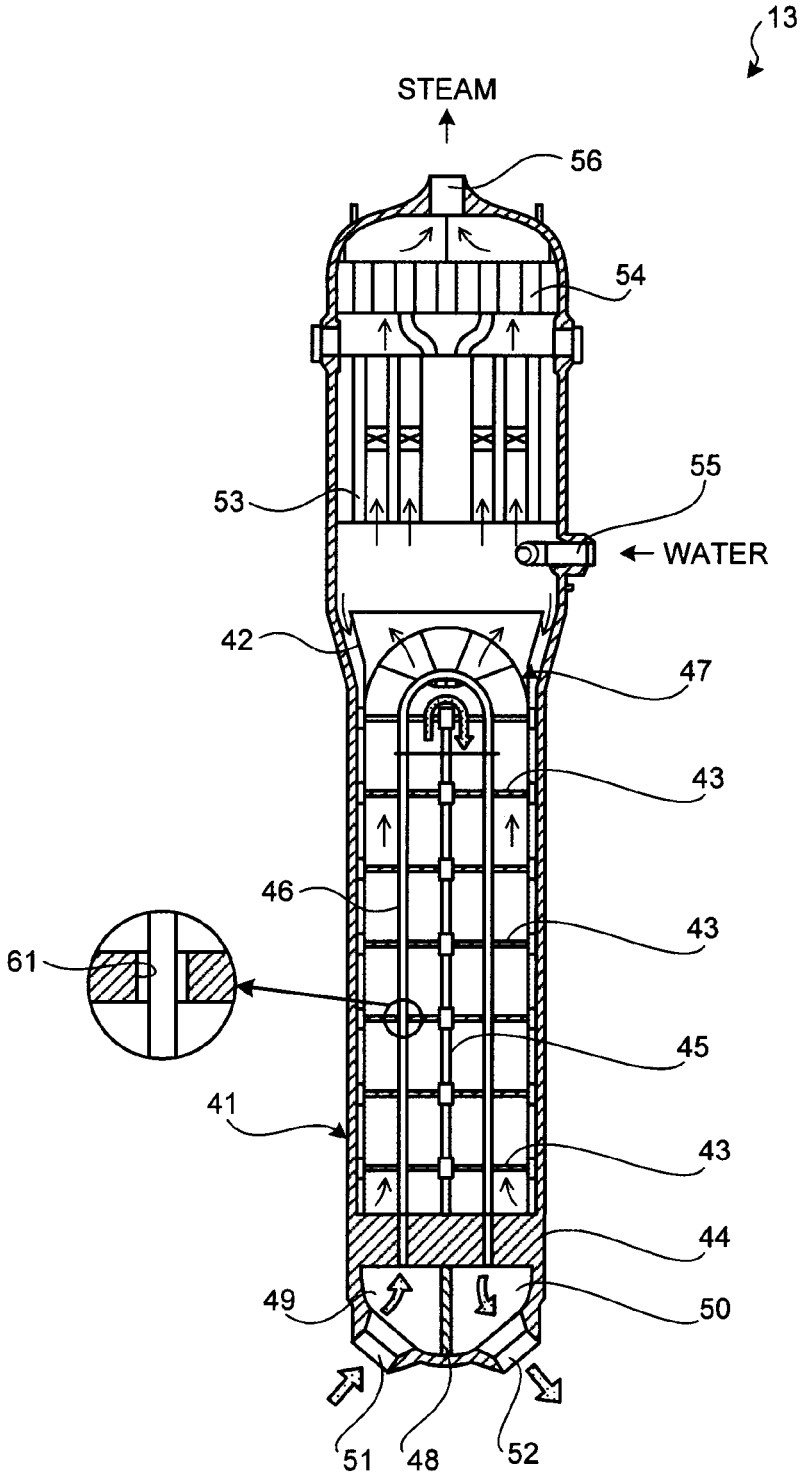
FIG. 15 is a schematic block diagram illustrating a steam generator of this embodiment.

FIG. 1 is a schematic view of the polishing apparatus according to an embodiment of the present invention, FIG. 2 is a front view of a machining head in the polishing apparatus of this embodiment, FIG. 3 is a plan view of the machining head in the polishing apparatus of this embodiment, FIG. 4 is a front view illustrating a support base in the polishing apparatus of this embodiment, FIG. 5 is a front view illustrating a support base in the polishing apparatus of this embodiment, FIG. 6 is a plan view illustrating a support base in the polishing apparatus of this embodiment, FIG. 7 is a schematic view illustrating a polishing method using the polishing apparatus of this embodiment, FIG. 8 is a schematic view illustrating the polishing method using the polishing apparatus of this embodiment, FIG. 9 is a schematic view illustrating an R chamfering device, FIG. 10 is a front view illustrating a spindle in the R chamfering device, FIG. 11 is a cross-sectional view of a floating holder, FIG. 12 is a cross-sectional view of a depth-adjusting holder, FIG. 13-1 is a plan view illustrating a prepared hole of a tube support plate, FIG. 13-2 is a plan view illustrating the prepared hole of the tube support plate and an R chamfered portion, FIG. 13-3 is a plan view illustrating a broached hole of the tube support plate, FIG. 14 is a flow chart illustrating a hole machining method of the tube support plate, and FIG. 15 is a schematic block diagram illustrating a steam generator of this embodiment.

The nuclear reactor of this embodiment is a pressurized water reactor (PWR) that uses light water as reactor coolant and neutron moderator to be high-temperature and high-pressure water that does not boil through the entire reactor internal, sends the high-temperature and high-pressure water to the steam generator to generate steam by heat exchange, and sends the steam to the turbine generator to generate electricity.

In a nuclear power plant having the pressurized water reactor of this embodiment, the pressurized water reactor and the steam generator are housed in a reactor containment vessel, and the pressurized water reactor and the steam generator are connected to each other via a cooling water pipe. Therefore, the primary cooling water is heated by fuel (atomic fuel), and the high-temperature primary cooling water is sent to the steam generator via the cooling water pipe. Heat exchange between the high-pressure and high-temperature primary cooling water and the secondary cooling water is performed in the steam generator, and the cooled primary cooling water is returned to the pressurized water reactor through the cooling water pipe.

In the steam generator 13 applied to the nuclear power plant thus configured, as illustrated in FIG. 15, a body portion 41 has a closed hollow cylindrical shape, and a lower part thereof has a slightly smaller diameter than an upper part. A tube bundle shroud 42 having a cylindrical shape at a predetermined interval from an inner wall surface is provided in the lower part of the body portion 41. A plurality of tube support plates 43 is disposed inside the tube bundle shroud 42 in response to a predetermined height position, a tube sheet 44 is fixed below the tube support plate 43, and each of the tube support plates 43 is supported by a plurality of stay rods 45 that extends upward from the tube sheet 44.

Moreover, a heat exchanger tube group 47 formed of a plurality of heat exchanger tubes 46 having an inverted U-shape is provided inside the tube bundle shroud 42, end portions of each of the heat exchanger tubes 46 are expanded and supported by the tube sheet 44, and intermediate portions thereof are supported by the tube support plates 43.

Further, the body portion 41 is partitioned into an entrance chamber 49 and an exit chamber 50 by a partition 48 below the tube sheet 44, is formed with an inlet nozzle 51 and an outlet nozzle 52, one end portions of each of the heat exchanger tubes 46 are in communication with the entrance chamber 49, and the other end portions thereof are in communication with the exit chamber 50.

Further, the body portion 41 is provided with a gas-water separator 53 that separates the water supply into steam and hot water above the heat exchanger tube group 47, and a moisture separator 54 that removes the moisture of the separated steam to be a state close to the dry steam. Further, a water supply tube 55 configured to perform the water supply of secondary cooling water is inserted into the body portion 41 between the heat exchanger tube group 47 and the gas-water separator 53, and a steam outlet 56 is formed in a ceiling portion. Moreover, the body portion 41 is provided with a water supply passage. The secondary cooling water supplied to the interior from the water supply tube 55 flows down between the water supply passage and the tube bundle shroud 42 and circulates upward at the tube sheet 44, and when rising inside the heat exchanger tube group 47, heat exchange between the secondary cooling water and the hot water (primary cooling water) flowing through each heat exchanger tube 46 is performed.

Therefore, the primary cooling water heated by the pressurized water reactor is sent to the entrance chamber 49 of the steam generator 13 through the cooling water pipe, circulates through the multiple heat exchanger tubes 46, and leads to the exit chamber 50. Meanwhile, the secondary cooling water cooled by the condenser is sent to the water supply tube 55 of the steam generator 13 through the cooling water pipe, and is subjected to heat exchange with the hot water (primary cooling water) flowing in the heat exchanger tube 46 through the body portion 41. That is, heat exchange between the high-pressure and high-temperature primary cooling water and the secondary cooling water is performed inside the body portion 41, and the cooled primary cooling water is returned to the pressurized water reactor from the exit chamber 50 through the cooling water pipe. Meanwhile, the secondary cooling water subjected to heat exchange with the high-pressure and high-temperature primary coolant rises inside the body portion 41, is separated into steam and hot water in the gas-water separator 53, and is sent to the steam turbine through the cooling water pipe, after removing the moisture of the steam in the moisture separator 54.

In the steam generator 13 having the above-described configuration, a plurality of tube support plates 43 is provided at the lower part of the body portion 41 at predetermined intervals, and the tube sheet 44 is provided at the lower end portion thereof. Moreover, the end portions of the plurality of heat exchanger tubes 46 forming the heat exchanger tube group 47 are fixed to the multiple mounting holes formed on the tube sheet 44, and the intermediate portions thereof are supported by the multiple mounting holes 61 formed in each of the tube support plates 43. Since it is necessary to convey the secondary cooling water (steam) heated by the primary cooling water to the upper part, the respective mounting holes 61 of the respective tube support plates 43 have the different forms that have a plurality of notches on the outer peripheral side of the circular form as the cross-sectional shape of the heat exchanger tube 46.

First, as illustrated in FIG. 13-1, the plurality of mounting holes 61 formed on the tube support plate (workpiece) 43 forms a prepared hole 62 on the tube support plate 43 by a prepared hole machining device. Next, as illustrated in FIG. 13-2, by performing R chamfering on the end portion in the axial direction of the prepared hole 62 by an R chamfering device, an R chamfered portion 63 is formed. Next, as illustrated in FIG. 13-3, by broaching the prepared hole 62 by a broaching device, broached holes 64 having the different shapes are formed. Moreover, by chamfering the end portion in the axial direction of the broached hole 64 by the polishing apparatus of this embodiment, the mounting holes 61 are formed.

In this case, as the prepared hole machining device that forms the prepared holes 62 in the tube support plate 43, for example, a multi-axis machining device that has been already filed by the present applicant is used (described in Japanese Patent No. 4831825).

Further, as the R chamfering device that forms the R chamfered portion 63 in the tube support plate 43, the following devices are used. As illustrated in FIG. 9, in the R chamfering device 71, a column 73 is fixed to an upper surface portion of a bed 72, and a saddle 74 is movably supported to a side portion of the column 73 along the vertical direction. Further, a screw shaft 76 is disposed on the column 73 along the vertical direction by a drive motor 75, and the screw shaft 76 is screwed to the saddle 74. Therefore, it is possible to move the saddle 74 up and down by the drive motor 75. Further, a machining head 77 is supported on the side portion of the saddle 74 to freely move along the horizontal direction, and can be moved by a drive motor (not illustrated). Moreover, a plurality (in this example, twelve, but not limited to this number) of spindles 78 is provided in the machining head 77 to be synchronously rotatable by the drive motor 79.

As illustrated in FIG. 10, a shaft portion 81 provided on a base end side of the spindle 78 is supported by the machining head 77 to be freely rotatable by bearings 82 and 83, and a drive gear 84 is fixed thereto. In this case, by engagement between drive gears 84, the twelve spindles 78 are freely synchronously rotatable. Further, a depth-adjusting holder (trade name) 86 as a position shift correction device is mounted on the leading end side of the spindle 78 via the floating holder 85, and a machining jig 87 is mounted thereto via the depth-adjusting holder 86.

As illustrated in FIG. 11, in the floating holder 85, a shell 91 has a cylindrical shape, and a cylindrical portion 92 formed integrally with the shaft portion 81 is fitted therein. On a leading end portion side of a collet 93, a connection hole 94 to which the base end portion of the depth-adjusting holder 86 is connected is formed, and an external flange 95 forming a link shape is formed in an intermediate portion thereof in the longitudinal direction. Moreover, the base end portion of the collet 93 is supported by the cylindrical portion 92 via a coupling 96, and the leading end portion thereof is supported on the shell 91 by a seal member 97. Further, the external flange 95 of the collet 93 is supported by a pair of front and rear thrust bearings 98. Therefore, the collet 93 is supported to be movable by a predetermined amount in the radial direction with respect to the shell 91 and the cylindrical portion 92, and is elastically supported at a concentric position.

In the depth-adjusting holder 86, as illustrated in FIG. 12, a shank 102 connected to the floating holder 85 is integrally formed with the base end portion of the collar 101, a mounting hole 103 is formed at the leading end portion thereof, and a connection flange 104 is formed. The base end portion of the sleeve 105 is fitted into the mounting hole 103 of the collar 101, a connection hole 106 connected to the machining jig 87 is formed at the leading end portion thereof, and a connection flange 107 is formed. A thimble 108 has a cylindrical shape and is disposed outside the collar 101 and the sleeve 105, a rear flange 109 is locked on the connection flange 104 of the collar 101, and meanwhile, an intermediate flange 110 is locked on the connection flange 107 of the sleeve 105. In this case, the connection flange 104 of the collar 101 faces the connection flange 107 of the sleeve 105 within the thimble 108 in the axial direction, and a spring member 111 is disposed therebetween.

Moreover, the stopper 112 is formed at the leading end portion of the thimble 108, the stopper 112 is elastically supported forward at a predetermined position by biasing force of the spring member 111, and is movable rearward against the biasing force of the spring member 111.

The machining jig 87 is mounted to the leading end portion of the depth-adjusting holder 86, and a shaft portion 121 fitted into the connection hole 106 is formed integrally with the base end portion thereof. Further, at the leading end portion of the machining jig 87, a sleeve 122 fitted to the prepared hole 62 of the tube support plate 43 is rotatably supported via a bearing (not illustrated). Moreover, the machining jig 87 is positioned on a base end side of the sleeve 122, and a cutting blade 123 is fixed via the fixing jig 125 by the fixing screw 124.

Therefore, as illustrated in FIGS. 9 to 12, the tube support plate 43 formed with a plurality of prepared holes 62 is supported in a state of vertically standing, and the machining head 77 is moved forward to come close to the tube support plate 43. At this time, the positions in the vertical and horizontal directions of the spindle 78 are adjusted in advance. Moreover, each spindle 78 is moved forward while rotating to insert the leading end portion thereof into the prepared hole 62 of the tube support plate 43.

At this time, when the radial position of each prepared hole 62 is shifted due to the deformation or the like of the tube support plate 43, by slight movement of the floating holder 85 in the radial direction, it is possible to absorb the position shift. Further, when the spindle 78 is inserted into the prepared hole 62 of the tube support plate 43, the stopper 112 abuts against the end surface of the tube support plate 43, and the machining jig 87 moves back. For that reason, even if the axial position of each prepared hole 62 is shifted due to the deformation of the tube support plate 43, it is possible to absorb the position shift, by the slight movement of the depth-adjusting holder 86 in the axial direction. Moreover, when the spindle 78 moves forward to a predetermined position, the cutting blade 123 of the machining jig 87 performs the R chamfering of the edge portion of the prepared hole 62 to form an R chamfered portion 63.

In the above description, the R chamfering was performed from one side of the tube support plate 43 by the R chamfering device 71, but the R chamfering may be performed from either side of the tube support plate 43, by applying the multi-axis machining device as in the prepared hole machining device.

Further, as the broaching device configured to form the broached holes 64 in the tube support plates 43, for example, a broaching device (described in JP 2010-286705 A) that has already filed by the present applicant may be used.

Moreover, the polishing apparatus configured to perform chamfering on the end portion in the axial direction of the broached hole 64 in the tube support plate 43 will be described. As illustrated in FIG. 1, in the polishing apparatus 201, a support base 203 may be fixed to the top of a base 202, and a support table 204 may be provided on the top of the support base 203. The support table 204 is formed in a disk shape, and a recess 205 having a disk shape capable of supporting the tube support plate 43 is formed on the upper surface portion. In addition, a lifter 206 is provided to freely move up and down at the central portion of the support base 203.

Further, in the base 202, a pair of guide rails 207 is laid at positions on both sides of the support base 203. A movable member 208 is formed of a rail portion 209 that is disposed to span over the support base 203, and leg portions 210 that are provided on either side of the rail portion 209 and are freely movable on the guide rails 207. Moreover, in the movable member 208, a first driving device 211 that rotates the guide roller (not illustrated) is provided in each of the leg portions 210, and by rotating the guide roller by the respective first moving devices 211, it is possible to move the movable member 208 along the guide rails 207.

Furthermore, the machining head 212 is supported to freely move along the rail portion 209 of the movable member 208. The machining head 212 is provided with a second driving device (machining head moving device) 213 that rotates the guide roller (not illustrated), and by rotating the guide roller by the second moving device 213, it is possible to move the machining head 212 along the rail portion 209.

The machining head 212 is able to move in two intersecting (orthogonal) horizontal directions (X-direction and Y-direction) by each of the driving devices 211 and 213.

Two polishing jigs 214 are provided to hang down at the bottom of the machining head 212, and are supported to be movable in the vertical direction (Z-direction) intersecting (orthogonal) with the direction of movement of the machining head 212. Moreover, the machining head 212 is able to press the polishing members 215 mounted on the lower end portions of each of the polishing jigs 214 against the upper surface (machining surface) of the tube support plate 43.

That is, as illustrated in FIGS. 2 and 3, the head main body 221 is freely movable along the guide rail 222 fixed to the movable member 208 (rail portion 209), and is movable by the second moving device 213. Two sets of guide rails 223 are fixed to a vertical wall portion of the head main body 221 along the vertical direction. Meanwhile, the guide members 225 engaged with the respective guide rails 223 are fixed to each of the two polishing jig main bodies 224, and each of the polishing jig main bodies 224 is freely movable on the guide rails 223 via the guide members 225. Further, two air cylinders (polishing jig moving device) 226 are mounted to the head main body 221, and the leading end portions of each of the drive rods (not illustrated) protruding downward are connected to the polishing jig main bodies 224, respectively.

Two polishing jigs 214 are rotatably supported on the support portions 227 of the polishing jig main bodies 224, respectively, and the polishing members 215 are freely attachable to and detachable from the lower surface of the circular plate portion 228 fixed to the lower end portion. Further, driven sprockets 229 are fixed to the upper end portions of the polishing jigs 214. The two drive motors 230 are fixed to the polishing jig main bodies 224, respectively, and driving sprockets 231 are fixed to the drive shafts protruding to the upper end portion. Moreover, endless drive belts 232 are wound around the driven sprockets 229 and the driving sprockets 231.

Therefore, when driving the drive motor 230, the driving sprockets 231 rotate, rotational force is transmitted to the driven sprockets 229 via the drive belts 232, and it is possible to rotate the polishing jigs 214 by rotating the driven sprockets 229. Further, when driving the air cylinders 226, the polishing jig main bodies 224 descends, and it is possible to lower the polishing jigs 214 mounted on the polishing jig main bodies 224. For that reason, when synchronously driving the drive motor 230 and the air cylinder 226, it is possible to press the polishing members 215 mounted on the bottom against the upper surface of the tube support plate 43 while rotating the polishing jig main bodies 224.

At this time, it is desirable to rotate the two polishing jigs 214 in the different directions, that is, one polishing jig 214 is rotated in a forward direction, and the other the polishing jig 214 is rotated in a reverse direction.

Further, as the polishing member 215 mounted on the polishing jig 214, the sandpaper and the polishing brush are applied. The polishing brush is formed by bundling nylon with kneaded abrasive gains (polyamide fibers).

Here, chamfering of the broached hole 64 of the tube support plate 43 using the polishing apparatus 201 will be described.

In the polishing operation using the polishing apparatus 201, as illustrated in FIG. 4, first, the respective polishing jigs 214 are raised to move the movable member 208 and the machining head 212 outward from the upper part of the support table 204. Next, the tube support plate 43 is lifted and moved by a crane (not illustrated) and is placed on the support table 204. At this time, the lifter 206 is allowed to wait at a raised position, and the tube support plate 43 is placed on the lifter 206. Further, as illustrated in FIG. 6, a plurality of stainless steel plates 216 is placed on the recess 205 of the support table 204 in advance such that the support table 204 and the tube support plate 43 are not in direct contact with each other. Moreover, after adjusting the horizontal position of the tube support plate 43 on the lifter 206, the lifter 206 is lowered to position the tube support plate 43 in the recess 205 of the support table 204. In addition, if the support table 204 is a member having corrosion resistance, for example, a member made of stainless steel, the tube support plate 43 may be directly placed on the support table 204.

Moreover, when the tube support plate 43 is positioned on the support table 204, the movable member 208 and the machining head 212 are moved, the two polishing jigs 214 are moved up to the center of the tube support plate 43, and the center of the two polishing jigs 214 is matched with the center of the tube support plate 43, thereby performing the origin adjustment. In this case, the center of the two polishing jigs 214 is a point between the centers of each of the polishing jigs 214.

When the origin adjustment of the two polishing jigs 214 is completed, each polishing jig 214 is moved to the initial position, and each polishing jig 214 is rotated here and pressed against the upper surface of the tube support plate 43 at a predetermined pressure. Moreover, each polishing jig 214 moves in the horizontal direction at a predetermined speed to perform chamfering over the entire surface of the tube support plate 43. In this case, the directions of rotation of the two polishing jigs 214 are set to be opposite to each other.

That is, as illustrated in FIG. 7, first, sandpaper (polishing member) 215 is mounted on the lower end portion of the polishing jig 214, the sandpaper 215 is pressed against the tube support plate 43 while rotating the polishing jig 214, and the sandpaper 215 is horizontally moved along the water surface of the tube support plate 43. Then, the polishing jig 214 is able to perform chamfering on the entire surface of the tube support plate 43 by the sandpaper 215. In this case, for example, the operation of moving the polishing jig 214 in the X-direction, thereafter, moving the polishing jig 214 by a predetermined distance (equal to or less than the diameter of the sandpaper) in the Y-direction, and moving the polishing jig 214 in the X-direction again is repeatedly moved.

Moreover, after chamfering the entire surface of the tube support plate 43 by the sandpaper 215, as illustrated in FIG. 8, the tube support plate 43 is moved to horizontally pivot by 90°. Similarly, by pressing the sandpaper 215 against the tube support plate 43 and horizontally moving the sandpaper 215 along the water surface of the tube support plate 43 while rotating the polishing jig 214, the entire surface of the tube support plate 43 is chamfered by the sandpaper 215. Moreover, when chamfering the entire surface of the tube support plate 43 twice by the sandpaper 215 of the polishing jig 214, the front and rear surfaces of the tube support plate 43 are inverted. Moreover, similarly, by pressing the sandpaper 215 against the tube support plate 43 and horizontally moving the sandpaper 215 along the water surface of the tube support plate 43 while rotating the polishing jig 214, the entire surface of the tube support plate 43 is chamfered twice by the sandpaper 215. Here, the first step is completed.

Next, the polishing brush (polishing member) 215 is mounted at the lower end portion of the polishing jig 214, and as illustrated in FIG. 7, the polishing brush 215 is pressed against the tube support plate 43 and is horizontally moved along the water surface of the tube support plate 43 while rotating the polishing jig 214. Then, the polishing jig 214 is able to chamfer the entire surface of the tube support plate 43 by the polishing brush 215. In this case, for example, the operation of moving the polishing jig 214 in the X-direction, thereafter, moving the polishing jig 214 in the Y-direction by a predetermined distance (equal to or less than the polishing brush), and moving the polishing jig 214 in the X-direction again is repeatedly moved.

Moreover, after chamfering the entire surface of the tube support plate 43 by the sandpaper 215, as illustrated in FIG. 8, the tube support plate 43 is moved to horizontally pivot by 90°. Similarly, by pressing the sandpaper 215 against the tube support plate 43 and horizontally moving the sandpaper 215 along the water surface of the tube support plate 43 while rotating the polishing jig 214, the entire surface of the tube support plate 43 is chamfered by the sandpaper 215. Moreover, when chamfering the entire surface of the tube support plate 43 twice by the sandpaper 215 of the polishing jig 214, the front and rear surfaces of the tube support plate 43 are inverted. Moreover, similarly, by pressing the sandpaper 215 against the tube support plate 43 and horizontally moving the sandpaper 215 along the water surface of the tube support plate 43 while rotating the polishing jig 214, the entire surface of the tube support plate 43 is chamfered twice by the sandpaper 215. Here, the second step is completed.

When forming the broached hole 64 by broaching the prepared hole 62 of tube support plate 43, burrs are liable to occur at the axial end portion of the broached hole 64, in other words, at the edge portion of the broached hole 64. The polishing apparatus 201 removes the burrs from the broached hole 64, and provides the smooth edge portions. That is, first, when performing the work by mounting the sandpaper as the polishing member 215 on the polishing jig 214, it is possible to remove the burrs generated at the edge portions of the broached hole 64 from the root. Next, when performing the work by mounting the polishing brush as the polishing member 215 on the polishing jig 214, by polishing the edge portions of the broached hole 64 from which the burrs are removed, it is possible to obtain the smooth surfaces of the edge portions.

As described above, as illustrated in FIG. 14, at step S11, the tube support plate 43 performs the prepared hole machining on the tube support plate 43 by the prepared hole machining device to form the prepared hole 62. At step S12, by performing the R chamfering on the end portion in the axial direction of the prepared hole 62 by the R chamfering device, the R chamfered portion 63 is formed. At step S13, by performing broaching on the prepared hole 62 by the broaching device, the broached holes 64 having the different shapes are formed. At step S14, by chamfering the end portion in the axial direction of the broached hole 64 by the polishing apparatus 201, the mounting holes 61 are formed. At step S15, after performing various inspections as finishing, at step S16, the tube support plate 43 is stored. Moreover, at a predetermined time, at step S17, an inserting operation of the tube support plate 43 with respect to the body portion (lower portion) 41 is performed.

The polishing apparatus of this embodiment is provided with two machining heads 212 that is supported to freely move in the horizontal direction, the driving devices 211 and 213 that allow the machining heads 212 to move, the polishing jig 214 that is supported on the machining head 212 to freely move in the vertical direction, the polishing member 215 that is mounted on the lower end portion of the polishing jig 214, the air cylinder 226 that is capable of pressing the polishing member 215 against the tube support plate 43 by moving the polishing jig 214, and the drive motor 230 that is capable of rotating the polishing jig 214.

Thus, since the polishing jig 214 supported by the machining head 212 is rotated by the drive motor 230, is pressed against the machining surface of the tube support plate 43 by the air cylinder 226, and is moved by the driving devices 211 and 213, it is possible to properly polish the machining surface of the tube support plate 43 by the polishing member 215 mounted to the polishing jig 214, and it is possible to simplify the structure by the simple configuration.

Further, the polishing apparatus of this embodiment is provided with the two polishing jigs 214, and it is possible to rotate each polishing jig 214 in the different directions. Thus, since each polishing member 215 of each polishing jig 214 comes into contact with the machining surface of the tube support plate 43 from the different directions, it is possible to perform the stable polishing.

Further, in the polishing apparatus of this embodiment, the sandpaper and the polishing brush as the polishing member 215 can be mounted to the leading end portion of the polishing jig 214. Therefore, since the members having the different hardness and shape come into contact with the machining surface of the tube support plate 43, it is possible to properly polish the machining surface.

Further, the polishing method of this embodiment has, when polishing the edge portion of the broached hole 64 formed in the tube support plate 43, a first step of mounting the sandpaper to the leading end portion of the polishing jig 214, pressing the sandpaper against the tube support plate 43 while rotating the polishing jig 214, and moving the sandpaper along the machining surface of the tube support plate 43; and a second step of mounting the polishing brush to the leading end portion of the polishing jig 214, pressing the polishing brush against the tube support plate 43 while rotating the polishing jig 214, and moving the polishing brush along the machining surface of the tube support plate 43.

Therefore, at the first step, by polishing the machining surface of the tube support plate 43 by the sandpaper, it is possible to remove the burrs formed on the edge portion of the broached hole 64, and at the second step, by polishing the machining surface of the tube support plate 43 by the polishing brush, it is possible to polish the edge portion of the broached hole 64 from which the burrs are removed, properly polish the edge portion of the broached hole 64, and simplify the structure by the simple construction.

Further, in the polishing apparatus of this embodiment, after pressing the polishing jig 214 against the machining surface of the tube support plate 43 while rotating the polishing jig 214, and moving the polishing jig 214 in a predetermined direction to polish the tube support plate 43, the tube support plate 43 rotates by 90° in the horizontal direction, the polishing jig 214 is pressed against the machining surface of the tube support plate 43 again while rotating the polishing jig 214, and the polishing jig 214 moves in a predetermined direction to polish the tube support plate 43. Therefore, since the polishing member 215 is pressed against the broached hole 64 formed in the tube support plate 43 from the different directions, it is possible to stably polish the edge portion of the broached hole 64.

In addition, in the above-described embodiments, as the machining head moving device of the present invention, the driving devices 211 and 213 were used, as the polishing jig moving device of the present invention, the air cylinder 226 was used, and as the polishing jig rotating device of the present invention, the drive motor 230 was used, but are not limited to this configuration.

Further, in the above-described embodiments, it was described as machining the tube support plate of the steam generator by the polishing apparatus of the present invention, but the workpiece is not limited to the tube support plate.

REFERENCE SIGNS LIST

13 STEAM GENERATOR
17 STEAM TURBINE
41 BODY PORTION
43 TUBE SUPPORT PLATE (WORKPIECE)
44 TUBE SHEET
61 MOUNTING HOLE
62 PREPARED HOLE
63 R CHAMFERED PORTION
64 BROACHED HOLE
71 R CHAMFERING DEVICE
201 POLISHING APPARATUS
203 SUPPORT BASE
204 SUPPORT TABLE
208 MOVABLE MEMBER
211 FIRST DRIVING DEVICE (MACHINING HEAD MOVING DEVICE)
212 MACHINING HEAD
213 SECOND DRIVING DEVICE (MACHINING HEAD MOVING DEVICE)
214 POLISHING JIG
215 POLISHING MEMBER (SANDPAPER, POLISHING BRUSH)
226 AIR CYLINDER (POLISHING JIG MOVING DEVICE)
230 DRIVE MOTOR (POLISHING JIG ROTATING DEVICE)

The invention claimed is:

1. A polishing apparatus comprising:

a support base attached to a base, the support base configured with an upper surface for supporting a workpiece horizontally in a first position;

a lifter provided at a central portion of the support base, configured to lower the workpiece onto the upper surface and lift the workpiece off of the upper surface;

a machining head supported to independently move in two intersecting directions parallel to the upper surface of the support base;

a machining head moving device that allows the machining head to independently move in the two intersecting directions;

a polishing jig supported by the machining head to freely move in a direction perpendicular to the upper surface of the support base;

a polishing member that is mounted on a leading end portion of the polishing jig;

a polishing jig moving device that moves the polishing jig in a direction perpendicular to the upper surface of the support base and is capable of pressing the polishing member against the workpiece;

a polishing jig rotating device that is capable of rotating the polishing jig about an axis center perpendicular to the upper surface of the support base;

wherein the upper surface of the support base is configured to support the workpiece horizontally in a second position wherein the second position is an angular rotation of the first position about a vertical axis, and wherein a top surface of the workpiece is polished by the polishing member in the first position, and wherein again the top surface of the workpiece is polished by the polishing member after the workpiece is rotated to be supported in the second position.

2. The polishing apparatus according to claim 1, wherein at least two polishing jigs are provided and are capable of rotating by the polishing jig rotating device in different directions.

3. The polishing apparatus according to claim 1, wherein sandpaper or polishing brush as the polishing member can be mounted to a leading end portion of the polishing jig.

4. A polishing method of polishing a top surface of a workpiece using a polishing apparatus, the polishing method comprising:

a first step of mounting the workpiece on an upper surface of a support base in a first position;

a second step of mounting sandpaper to a leading end portion of a polishing jig, pressing the sandpaper against the workpiece while rotating the polishing jig, and moving the sandpaper along the top surface of the workpiece;

a third step of mounting a polishing brush to the leading end portion of the polishing jig, pressing the polishing brush against the workpiece while rotating the polishing jig, and moving the polishing brush along the top surface of the workpiece, wherein the polishing apparatus comprising:

the support base attached to a base, the support base configured with the upper surface for supporting the workpiece horizontally in the first position;

a lifter provided at a central portion of the support base configured to lower the workpiece onto the upper surface and lift the workpiece off of the upper surface;

a machining head supported to independently move in two intersecting directions parallel to the upper surface of the support base;

a machining head moving device that allows the machining head to independently move in the two intersecting directions;

the polishing jig supported by the machining head to freely move in a direction perpendicular to the upper surface of the support base;

a polishing member comprising the sandpaper or the polishing brush is mounted on the leading end portion of the polishing jig;

a polishing jig moving device that moves the polishing jig in a direction perpendicular to the upper surface of the support base and is capable of pressing the polishing member against the workpiece;

a polishing jig rotating device that is capable of rotating the polishing jig about an axis center perpendicular to the upper surface of the support base;

wherein the upper surface of the support base is configured to support the workpiece horizontally in the second position wherein the second position is an angular rotation of the first position about a vertical axis, and wherein the top surface of the workpiece is polished by the polishing member in the first position, and wherein again the top surface of the workpiece is polished by the polishing member after the workpiece is rotated to be supported in the second position.

5. The polishing method according to claim 4, wherein the workpiece is polished while rotating at least two polishing jigs in different directions.

6. The polishing apparatus according to claim 2, wherein sandpaper or polishing brush as the polishing member can be mounted to a leading end portion of the polishing jig.

7. The polishing method according to claim 4, further comprising a step of rotating the workpiece to the second position after the second step and prior to the third step.

8. The polishing method according to claim 4, wherein the polishing brush comprises nylon bundled with kneaded abrasive grains.

9. The polishing method according to claim 4, wherein the angular rotation is 90°.

10. The polishing method according to claim 4, wherein the top surface of a workpiece comprises at least one edge portion of a hole formed therein.

* * * * *